US005659930A

United States Patent [19]

Okawa

[11] Patent Number: 5,659,930

[45] Date of Patent: Aug. 26, 1997

[54] SURFACE-TYPE FASTENER HAVING A THICK FOUNDATION FABRIC

[75] Inventor: Mitsuhisa Okawa, Toyama-ken, Japan

[73] Assignee: YKK Corporation, Japan

[21] Appl. No.: 413,948

[22] Filed: Mar. 30, 1995

[30] Foreign Application Priority Data

Apr. 22, 1994 [JP] Japan ..... 6-084334

[51] Int. Cl.[6] ..... A44B 18/00

[52] U.S. Cl. ..... 24/445; 24/446; 24/448; 24/450; 428/218

[58] Field of Search ..... 24/445, 446, 448, 24/450; 428/218, 223

[56] References Cited

U.S. PATENT DOCUMENTS

| | | | |
|---|---|---|---|
| 3,387,345 | 6/1968 | Savoir | 24/446 |
| 3,555,630 | 1/1971 | Wylde . | |
| 4,041,549 | 8/1977 | Atkinson | 24/450 |
| 4,646,397 | 3/1987 | Yoshida | 24/448 X |
| 4,818,580 | 4/1989 | Bottger et al. | 428/218 X |
| 5,169,709 | 12/1992 | Fleischer . | |
| 5,231,738 | 8/1993 | Higashinaka | 24/450 |
| 5,399,418 | 3/1995 | Hartmanns et al. | 428/218 |
| 5,436,051 | 7/1995 | Donaruma et al. | 24/448 X |
| 5,457,855 | 10/1995 | Kenney et al. | 24/445 |

FOREIGN PATENT DOCUMENTS

| | | | |
|---|---|---|---|
| 0 217 549 | 4/1987 | European Pat. Off. . | |
| 0 258 015 | 3/1988 | European Pat. Off. . | |
| 917276 | 1/1963 | United Kingdom | 428/218 |

*Primary Examiner*—Peter M. Cuomo
*Assistant Examiner*—Hanh V. Tran
*Attorney, Agent, or Firm*—Hill, Steadman & Simpson

[57] ABSTRACT

A first foundation fabric having on its one surface a number of raised interlocking elements and a second foundation fabric having weft threads of monofilaments are woven or knitted integrally with each other by means of connecting threads. The first and second foundation fabrics are firmly and integrally united together by a synthetic resin layer to form a surface-type fastener having a thick foundation fabric. The surface-type fastener of the foregoing construction does not require a conventional sewing process, can therefore be produced efficiently, can readily be rolled up on a reel, obviates the need for a complicated inventory management which would occur when the first and second foundation fabrics are stocked separately in view of the dimensions and colors of the respective foundation fabrics, is able to prevent the first and second foundation fabrics from separating during use of the surface-type fastener, and hence continuously maintains the necessary strength throughout the service life.

16 Claims, 3 Drawing Sheets

SURFACE-TYPE FASTENER HAVING A THICK FOUNDATION FABRIC

BACKGROUND OF THE INVENTION

1. Field of the Invention

The present invention relates to a surface-type fastener having a thick foundation fabric and stable in shape and configuration.

2. Description of the Prior Art

Conventional surface-type fasteners produced by weaving or knitting generally have a foundation fabric which is woven or knitted as thin as possible within an allowable range of strength in view of the required flexibility. The woven or knitted foundation fabric is then coated on its back surface with a synthetic resin such as polyurethane, so that the base portion of a number of raised interlocking elements composed of piles or hooks on the front surface of the foundation fabric is firmly secured to the foundation fabric. In the case where the conventional surface-type fastener is used as a binding strip, a backing material, such as a woven fabric, a knitted fabric, a leather or a non-woven fabric, is temporarily attached or tacked to the back surface of the foundation fabric either by adhesive bonding using an adhesive or a pressure sensitive adhesive double-coated tape, or alternatively by fusion bonding. The foundation fabric and the backing material are subsequently united together by sewing so as to provide desired thickness and stiffness.

The foregoing manner of unification, which is achieved by first tacking with an adhesive, for example, and then sewing the conventional surface-type fastener and the backing material, requires a plurality of manufacturing processes and hence lowers the productivity. Furthermore, due to the necessity of providing various backing materials which are well matched with the dimensions and colors of different conventional surface-type fasteners, the stock or inventory management is rendered extremely complicated.

Moreover, the aforesaid adhesive bonding using an adhesive or a pressure sensitive adhesive double-coated tape, or the fusion bonding is no more than tacking. Accordingly, the tacked portion may be separated during use of the binding strip, thus causing the surface-type fastener to separate from the backing material along its portion other than those sewn to the backing material. The surface-type fastener eventually becomes floating on the backing material along a portion defined between two adjacent lines of sewing stitches.

SUMMARY OF THE INVENTION

With the foregoing drawbacks in view, an object of the present invention is to provide a surface-type fastener having a thick foundation fabric, which is improved in productivity, is easy about inventory management and excels in bonding strength and configuration stability.

To attain the foregoing object, there is provided according to the present invention a surface-type fastener having a thick foundation fabric, which fastener comprising: a first foundation fabric formed by weaving or knitting and having a number of female and/or male interlocking elements projecting from one surface of the first foundation fabric; a second foundation fabric underlying the other surface of the first foundation fabric and woven or knitted simultaneously with the first foundation fabric via connecting threads, the second foundation fabric being coarser in density than the first foundation fabric; and a synthetic resin layer formed by impregnating the first and second foundation fabrics with a synthetic resin material. The second foundation fabric has weft threads composed preferably of monofilaments.

Preferably, the female interlocking elements are composed of a warp pile having a mass of raised uncut loops of multifilaments, and the male interlocking elements are formed from a warp pile having a mass of raised loops of monofilaments each having a top end portion shaped into a hook or a radially and outwardly swelled head.

The female interlocking elements or the male interlocking elements may be arranged over the entire surface of the first foundation fabric either alone or in combination with the mating interlocking elements. Alternatively, a plurality of female interlocking element rows and a plurality of male interlocking element rows may be arranged alternately in the widthwise direction of the first foundation fabric. As a further alternative, the female interlocking elements and the male interlocking elements may be arranged separately over predetermined areas on the surface of the first foundation fabric separated in the direction of weaving or knitting of the first and second foundation fabrics.

Since the first foundation fabric and the second foundation fabric are integrally woven or knitted by the connecting threads, and since the first and second foundation fabrics are integrally united together by the synthetic resin layer, a conventional sewing process can be omitted, which leads to simplification of the overall manufacturing process. It is also possible to obviate the need for a complicated inventory management which would occur when the first and second foundation fabrics are stored separately for the purpose of managing the dimensions and colors of the respective foundation fabrics. Furthermore, the first and second foundation fabrics are completely prevented from separating during use with the result that the desired strength of the surface-type fastener can be maintained.

In the case where the weft threads of the second foundation fabric are composed of monofilaments, it is possible to stabilize the shape and configuration of a final product, facilitate rolling-up of an elongated continuous surface-type fastener, and maintain the desired stability in shape and configuration of the final product during storage.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
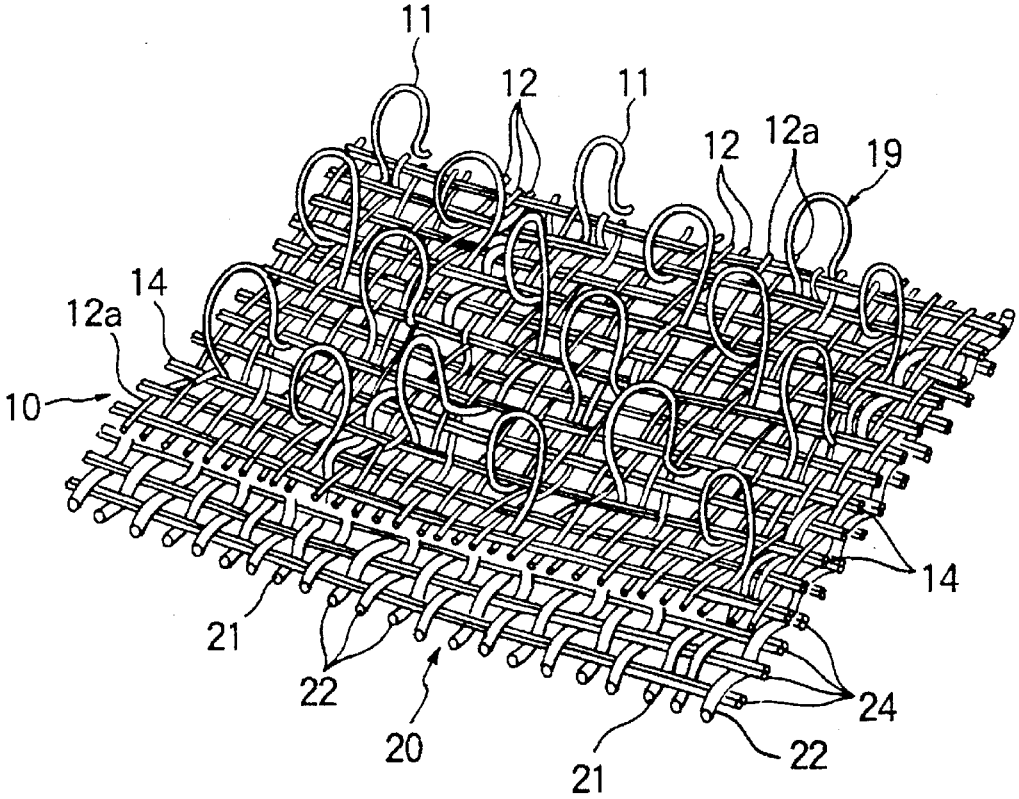
FIG. 1 is a schematic perspective view showing a main portion of the structure of a stitched double cloth composed of first and second foundation fabrics used in this invention.

Certain preferred embodiments of the present invention will be described below in greater detail with reference to the accompanying drawings. In this embodiment, foundation fabrics may be formed by weaving, however, they may be formed by knitting instead of weaving. FIG. 1 illustrates a portion of a double cloth composed of a first foundation fabric 10 and a second foundation fabric 20, partly omitted, each of which forms one part of the present invention. The illustrated double cloth is a narrow tape-like woven fabric woven on a needle loom having a small width. The first and second foundation fabrics 10 and 20 each have a weft thread 14, 24 laid in double picks in such a manner as to form a two-ply thread.

The first foundation fabric 10 is a part which corresponds to a conventional surface-type fastener having female interlocking elements. In the illustrated embodiment, the first foundation fabric 10 has a plurality of pile threads 11 composed of multifilaments and forming a number of female or looped interlocking elements 13 on a front surface of the first foundation fabric 10. Each of the pile threads 11 extends over two adjacent foundation warp threads 12 to form a raised loop, then is interwoven with the weft threads 14, subsequently extends again over the same two foundation warp threads 12 to form a next raised loop, and thereafter repeats the foregoing weaving pattern with the result that a large number of raised female or looped interlocking elements 13 arranged in rows and tiers at predetermined intervals or pitches are formed. Although the first foundation fabric 10 has a base woven structure composed of a plain weave, two adjacent warp threads 12*a* laid next to eight consecutive foundation warp threads 12 are so woven as to form a leno fabric. In general, the warp threads 12 and the weft threads 14 are composed of multifilaments, however, either or both of these threads 12, 14 may be composed of monofilaments.

The monofilaments and the multifilaments are composed of a filament formed by spinning from a synthetic resin material such as polyester, polyamide, polyacryl or polypropylene. Fibrous materials eligible for the foundation fabrics may include a variety of semisynthetic or natural fibers other than the synthetic resin materials specified above.

Figure 2:
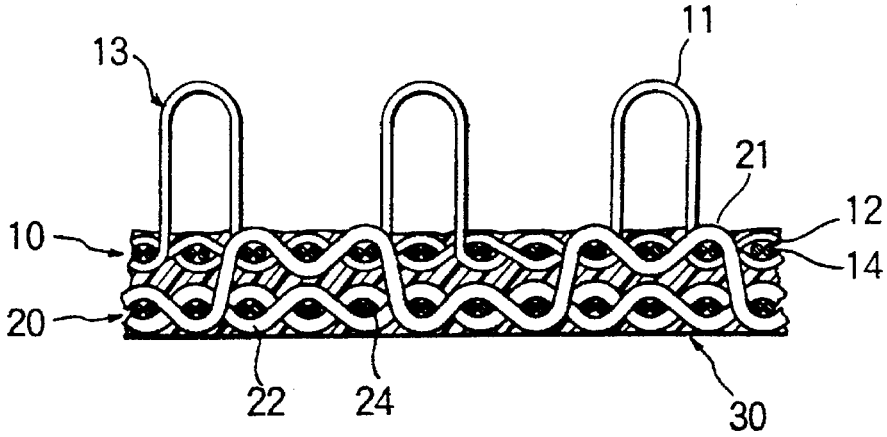
FIG. 2 is a fragmentary cross-sectional view showing a typical example of the structure of a surface-type fastener having female interlocking elements.

The second foundation fabric 20 is woven integrally with the first foundation fabric 10 by means of a plurality of connecting threads 21. Although the base woven structure of the second foundation fabric 20 is a plain weave, a warp thread laid next to twelve consecutive foundation warp threads 22 is used as one of the connecting threads 21. As shown in FIGS. 1 and 2, the connecting threads 21 are also interwoven in the first foundation fabric 10 simultaneously with weaving of the first foundation fabric 10, so that the first and second foundation fabrics 10, 20 are integrally connected by the connecting threads 21. The connecting threads 21 and the foundation warp threads 22 of the second foundation fabric 20 are both composed of multifilaments, however, a variety of spun yarns and monofilaments may be used according to the usage of the surface-type fastener. In the illustrated embodiment, the weft threads 24 of the second foundation fabric 20 are composed of monofilaments made from any one of the materials specified above, for the purpose of not only stabilizing the form and configuration of a final product, but also facilitating roll-up operation of an elongated continuous surface-type fastener, thus insuring the stability in shape and configuration of the final product during storage.

In general, the second foundation fabric 20 of the foregoing construction is so designed as to have a weaving density lower or coarser than that of the first foundation fabric 10, and the connecting threads 21 and the warp threads 22 used therein are each composed of a thread having a larger count of yarn than the warp threads 12 of the first foundation fabric 10. The weaving density and the yarn count value may obviously be varied according to the usage of the surface-type fastener. However, in consideration of the permeability of synthetic resin described later, an extremely high weaving density is not preferable. The connecting threads 21 and the warp threads 22 may be composed of monofilaments or yarns made from any one of the synthetic resin fibers, semisynthetic fibers and natural fibers described above.

Figure 3:
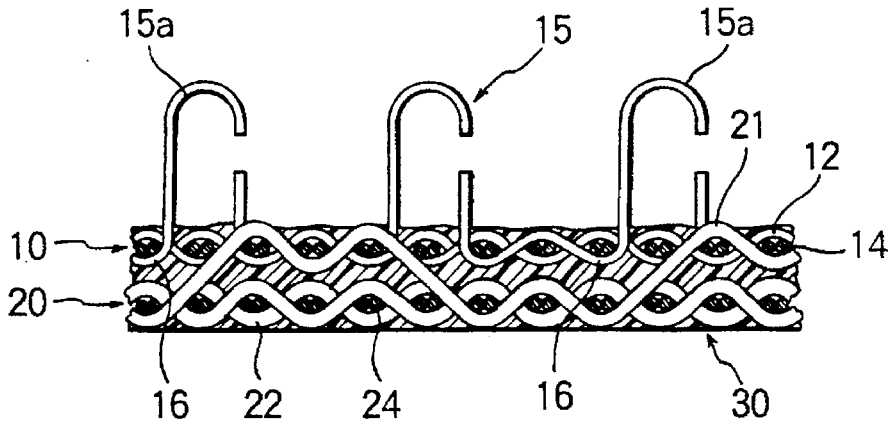
FIG. 3 is a fragmentary cross-sectional view showing a typical example of the structure of a surface-type fastener having male interlocking elements.

FIG. 3 illustrates another structural example of the foundation fabric 10 having on its front surface a number of male interlocking elements 15 each provided on its upper end with a hook 15*a*. The interlocking elements 15 are composed of monofilaments made from a synthetic resin material, such as polyester, polyamide, polyacryl or polypropylene, which is the same as the monofilament used in the first foundation fabric 10 described above. According to the woven structure of the first foundation fabric 10 shown in FIG. 3, the male interlocking elements 15 are formed in such a manner that the monofilaments are interwoven in the first foundation fabric 10 so as to form a pile having a mass of raised uncut loops on the first foundation fabric 10 in the same manner as the female interlocking elements 13 of FIG. 2, and subsequently the loops on the pile are cut at one side to form hooks 15*a* in the usual manner using a known comb-like cutting tool. The shape of a top end of the male interlocking elements 15 should by no means be limited to the hooks 15*a* described above. Alternatively, it is possible to cut away or remove a round head portion of each loop on the first foundation pile fabric 10, and subsequently a cut end of the loop is shaped into a radially outwardly swelled mushroom-like head 15*b* such as shown in FIG. 4 either by forcing the cut end of the loop against a hot plate having a number of hemispherical recesses or by bringing a heat source close to the cut end of the loop.

The double cloth which is composed of the aforesaid first and second woven foundation fabrics 10 and 20 integrally connected together by the connecting threads 21 is then impregnated with a synthetic resin. The impregnating synthetic resin should preferably be a material having a good adhesive property relative to the first and second foundation fabrics 10, 20. Eligible materials for the impregnating synthetic resin may include polyester resin, polyamide resin, polyacryl resin, polyurethane resin, and various synthetic rubbers. To achieve the impregnation, the second foundation fabric 20 is coated on its back surface with a solvent solution of any one of the synthetic resin specified above or a melt of the synthetic resin of the same synthetic resin, which has been added with an extender, a surface-active agent, a curing agent and the like. Then, a pressure is applied from a suitable means to the coated back surface of the second foundation fabric 20 whereupon the synthetic resin solution or melt is forced to flow successively into the second foundation fabric 20 and the first foundation fabric 10 until the first and second foundation fabrics 10, 20 are fully impregnated with the synthetic resin. The thus impregnated first and second foundation fabrics 10, 20 are then heated to cure the impregnating synthetic resin. In this instance, since the second foundation fabric 20 has a lower weaving density than the first foundation fabric 10 and hence has a sufficient degree of permeability of synthetic resin, the impregnating synthetic resin is readily able to reach the inside of the first foundation fabric 10 in a short time.

Figure 4:
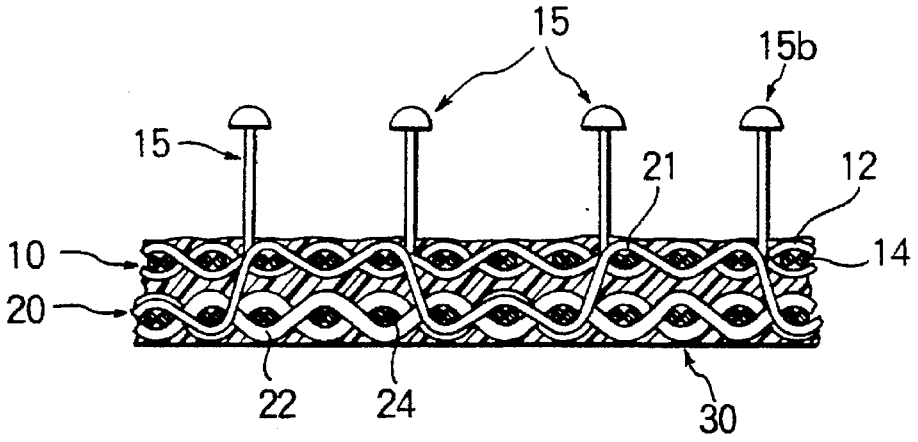
FIG. 4 is a fragmentary cross-sectional view showing another typical example of the structure of a surface-type fastener having male interlocking elements.

FIGS. 2–4 show in cross section typical different examples of the surface-type fastener having a thick foundation fabric produced according to the present invention.

As shown in these figures, there is a synthetic resin layer 30 which is interposed between the first and second foundation fabrics 10 and 20 and which fills up the inside of the first and second foundation fabrics 10, 20. Thus, and first and second foundation fabrics 10, 20 and the synthetic resin layer 30 are firmly united together. The thickness of a portion of the synthetic layer 30 lying between the first and second foundation fabrics 10 and 20 can be determined by adjusting the distance between respective joined portions of the first and second foundation fabrics 10, 20 which are interconnected by the connecting threads 21 when the double cloth is woven. As will be understood from FIGS. 3 and 4, the stiffness of the first foundation fabric 10 can be varied by changing the thickness or diameter of the connecting threads 21.

In the illustrated embodiments, the front surface of the surface-type fastener is provided with a number of raised interlocking elements 13, 15 having the same shape and configuration. However, it is also possible according to the present invention to arrange the female interlocking elements 13 and the male interlocking elements 15 in combination on the front surface of a single surface-type fastener. To this end, during weaving of a double cloth, a plurality of pile threads 11 (FIG. 2) composed of multifilaments for forming female or looped interlocking elements 13 and a plurality of monofilaments 16 (FIG. 3) for forming male interlocking elements 15 are arranged alternately in the widthwise direction of the double cloth being woven. After the weaving, loops of the monofilaments 16 projecting from the first foundation fabric 10 are cut at one side to form hooks 15*a* (FIG. 3). As an alternative, the pile threads 11 composed of the multifilaments described above and the monofilaments 16 for forming the male interlocking elements may be arranged alternately and interwoven in the first foundation fabric 10 to form a double cloth (surface-type fastener) in such a manner that a portion of the surface-type fastener extending over a predetermined length of the surface-type fastener is provided solely with loops of the pile threads 11, and an adjacent portion of the surface-type fastener extending over the predetermined length of the surface-type fastener is provided solely with loops of the monofilaments 16 which are subsequently cut to form hooks. The thus formed surface-type fastener has areas of female interlocking elements and areas of male interlocking elements arranged alternately in the lengthwise direction of the surface-type fastener and each having the predetermined length.

Figure 5:
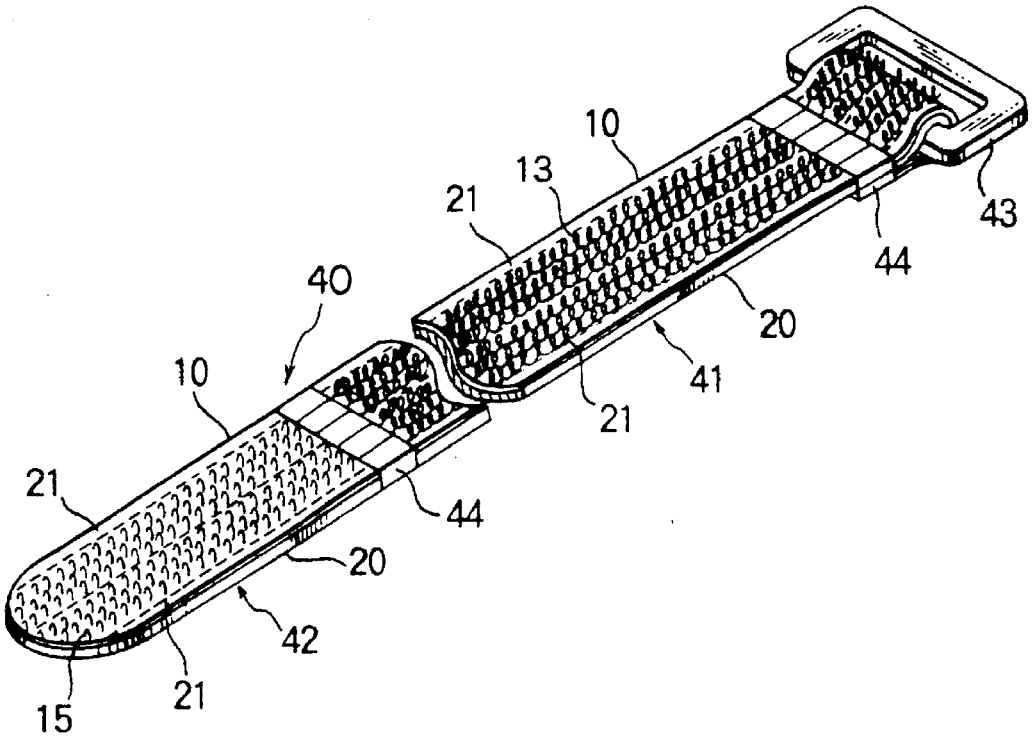
FIG. 5 is a perspective view showing an example of the binding device including female and male surface-type fasteners according to the present invention.

FIG. 5 exemplifies a binding device 40 which includes a female surface-type fastener 41 having female interlocking elements 13 of the present invention used in combination with a male surface-type fastener 42 having male interlocking elements 15 of the present invention. One end of the female surface-type fastener 41 having a predetermined length is threaded through a ring member 43 of metal or synthetic resin, then folded back, and finally attached to the female surface-type fastener body by means of a fastening device 44. The opposite end of the female surface-type fastener 41 is held in abutment with one end of the male surface-type fastener 42 and firmly attached to the latter by means of a similar fastening device 44, so that the binding device 40 is formed. When the binding device 40 is used for binding a plurality of articles, the binding device 40 is first wound around the articles with the female and male interlocking elements 13 and 15 faced outwardly, and then the free end of the male surface-type fastener 42 is threaded through the ring member 43 to tightly bind the articles. The free end of the male surface-type fastener 42 is subsequently turned or folded back about a portion of the ring member 43, and finally pressed against the female surface-type fastener 41 so that the male interlocking elements 15 on the free end of the male surface-type fastener 42 are engaged with the female interlocking elements 13 on a portion of the female surface-type fastener 41.

In the embodiment shown in FIG. 5, the female surface-type fastener 41 and the male surface-type fastener 42 are connected end to end by the fastening device 44. However, the fastening device 44 used for connecting the female and male surface-type fasteners 41 and 42 can be omitted when the female and male interlocking elements 13, 15 are formed in combination on one surface of a single woven surface-type fastener, or when a female surface-type fastener 41 and a male surface-type fastener 42 are continuously woven one after another. Thus, the binding device 40 can be produced using a single surface-type fastener.

It is apparent from the foregoing description that the surface-type fastener of this invention includes a first foundation fabric 10 having on its front surface a number of raised interlocking elements 13, 15, and a second foundation fabric 20 integrally woven or knitted with the first foundation fabric by means of connecting threads 21. The first and second foundation fabrics 10, 20 are impregnated with a synthetic resin so that confronting inside surfaces of the first and second foundation fabrics 10, 20 are firmly connected together. With this construction, the surface-type fastener excels in productivity and is able to prevent the first and second foundation fabrics 10, 20 from separating under severe conditions of use. Furthermore, by using a first foundation fabric 10 having a woven or knitted structure similar to that of the conventional surface-type fastener, and by properly selecting the count of yarn for the threads forming the second foundation fabric 20, a surface-type fastener having a desired thickness can be produced without affecting the bonding strength between, and the stability in shape and configuration of, the first and second foundation fabrics 10, 20. In the case where weft threads 24 of the second foundation fabric are composed of monofilaments, a final product (surface-type fastener) can be readily rolled up on a reel and hence is convenient for storage. Since the second foundation fabric 20 is coarser in weaving or knitting density than the first foundation fabric 10, the impregnating synthetic resin can readily penetrate the second foundation fabric 20 and subsequently flows into the first foundation fabric 20. The first foundation fabric 20 can, therefore, be fully impregnated with the synthetic resin. Furthermore, the first and second foundation fabrics 10. 20 woven or knitted integrally can be readily matched with each other in terms of the dimensions and color, making it possible to obviate the need for a complicated inventory management.

Obviously, various minor changes and modifications of the present invention are possible in the light of the above teaching. It is therefore to be understood that within the scope of the appended claims the invention may be practiced otherwise than as specifically described.

What is claimed is:

1. A surface-type fastener having a thick foundation fabric, comprising:

a first woven foundation fabric having a number of fastener elements projecting from one surface of said first foundation fabric;

a second woven foundation fabric underlying the other surface of said first foundation fabric and woven with said first woven foundation fabric via connecting threads, said second woven foundation fabric being coarser in density than said first foundation fabric; and a synthetic resin layer formed by impregnating said first and second woven foundation fabrics with a synthetic resin material.

2. A surface-type fastener according to claim 1, wherein said second foundation fabric has weft threads composed of monofilaments.

3. A surface-type fastener according to claim 1, wherein said fastener elements comprise a first warp pile having a mass of raised uncut loops of multifilaments, and a second warp pile having a mass of raised cut loops of monofilaments each having a top end portion in the form of a hook.

4. A surface-type fastener according to claim 2, wherein said fastener elements comprise female interlocking elements and male interlocking elements arranged separately in corresponding predetermined areas of said first foundation fabric spaced in the direction of weaving of said first and second foundation fabrics.

5. A surface-type fastener according to claim 2, wherein said fastener elements comprise female interlocking elements and male interlocking elements arranged together in a same area of said first foundation fabric.

6. A surface-type fastener according to claim 1, wherein said fastener elements comprise a first warp pile having a mass of raised uncut loops of multifilaments, and a second warp pile having a mass of raised cut loops of monofilaments each having a top end portion in the form of a radially and outwardly swelled head.

7. A surface-type fastener having a thick foundation fabric, comprising:

a first knitted foundation fabric having a number of fastener elements projecting from one surface of said first foundation fabric;

a second knitted foundation fabric underlying the other surface of said first foundation fabric and knitted with said first knitted foundation fabric via connecting threads, said second knitted foundation fabric being coarser in density than said first foundation fabric; and a synthetic resin layer formed by impregnating said first and second knitted foundation fabrics with a synthetic resin material.

8. A surface-type fastener according to claim 7, wherein said second foundation fabric has weft threads composed of monofilaments.

9. A surface-type fastener according to claim 7, wherein said fastener elements comprise a first warp pile having a mass of raised uncut loops of multifilaments, and a second warp pile having a mass of raised cut loops of monofilaments each having a top end portion in the form of a hook.

10. A surface-type fastener according to claim 8, wherein said fastener elements comprise female interlocking elements and male interlocking elements arranged separately in corresponding predetermined areas of said first foundation fabric spaced in the direction of weaving of said first and second foundation fabrics.

11. A surface-type fastener according to claim 8, wherein said fastener elements comprise female interlocking elements and male interlocking elements arranged together in a same area of said first foundation fabric.

12. A surface-type fastener according to claim 7, wherein said fastener elements comprise a first warp pile having a mass of raised uncut loops of multifilaments, and a second warp pile having a mass of raised cut loops of monofilaments each having a top end portion in the form of a radially and outwardly swelled head.

13. A surface-type fastener according to claim 1, wherein said fastener elements comprise female interlocking elements and male interlocking elements arranged separately in corresponding predetermined areas of said first foundation fabric spaced in the direction of weaving of said first and second foundation fabrics.

14. A surface-type fastener according to claim 1, wherein said fastener elements comprise female interlocking elements and male interlocking elements arranged together in a same area of said first foundation fabric.

15. A surface-type fastener according to claim 7, wherein said fastener elements comprise female interlocking elements and male interlocking elements arranged separately in corresponding predetermined areas of said first foundation fabric spaced in the direction of weaving of said first and second foundation fabrics.

16. A surface-type fastener according to claim 7, wherein said fastener elements comprise female interlocking elements and male interlocking elements arranged together in a same area of said first foundation fabric.

* * * * *